US012339047B2

(12) United States Patent
Sheaffer et al.

(10) Patent No.: US 12,339,047 B2
(45) Date of Patent: Jun. 24, 2025

(54) SYSTEM AND METHOD FOR OPERATION OF VARIABLE GEOMETRY DIFFUSER AS CHECK VALVE

(71) Applicant: Johnson Controls Tyco IP Holdings LLP, Milwaukee, WI (US)

(72) Inventors: Bryson Lee Sheaffer, Mechanicsburg, PA (US); Jordan Quinn Steiner, York, PA (US); Paul William Snell, York, PA (US); Curtis Christian Crane, York, PA (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 226 days.

(21) Appl. No.: 17/802,484

(22) PCT Filed: Feb. 26, 2021

(86) PCT No.: PCT/US2021/020049

§ 371 (c)(1),
(2) Date: Aug. 25, 2022

(87) PCT Pub. No.: WO2021/174097

PCT Pub. Date: Sep. 2, 2021

(65) Prior Publication Data

US 2023/0147950 A1 May 11, 2023

Related U.S. Application Data

(60) Provisional application No. 62/982,573, filed on Feb. 27, 2020.

(51) Int. Cl.
*F25B 49/02* (2006.01)
*F04D 27/00* (2006.01)
(Continued)

(52) U.S. Cl.
CPC ..... *F25B 49/022* (2013.01); *F04D 27/002* (2013.01); *F04D 29/442* (2013.01);
(Continued)

(58) Field of Classification Search
CPC ..... F25B 49/022; F25B 31/026; F25B 41/20; F25B 2500/27; F25B 2600/2519;
(Continued)

(56) References Cited

U.S. PATENT DOCUMENTS 5,116,197 A 5/1992 Snell
7,905,102 B2 * 3/2011 Bodell, II ..... F04D 27/0253 415/146

(Continued)

FOREIGN PATENT DOCUMENTS

CN 101861487 A 10/2010
CN 102341604 A 2/2012
CN 107313987 A 11/2017

OTHER PUBLICATIONS

International Search Report and Written Opinion for PCT Application No. PCT/US2021/020049, mailed Jun. 22, 2021, 13 pages.

(Continued)

*Primary Examiner* — Marc E Norman
(74) *Attorney, Agent, or Firm* — Fletcher Yoder, P.C.

(57) ABSTRACT

A compressor includes a diffuser passage configured to receive refrigerant flow from an impeller of the compressor, where the diffuser passage is at least partially defined by a compressor discharge plate of the compressor. The compressor also includes a variable geometry diffuser positioned within the diffuser passage and configured to adjust a dimension of a refrigerant flow path through the diffuser passage, an actuator coupled to the variable geometry diffuser and configured to adjust a position of the variable geometry diffuser within the diffuser passage, and a con- (Continued)

troller configured to regulate operation of the actuator. The controller is configured to instruct the actuator to adjust the position of the variable geometry diffuser from a first position to a second position using a first force and to adjust the position of the variable geometry diffuser from the second position to a third position using a second force less than the first force, where the variable geometry diffuser abuts the compressor discharge plate in the third position.

20 Claims, 7 Drawing Sheets

(51) Int. Cl.
*F04D 29/44* (2006.01)
*F25B 31/02* (2006.01)
*F25B 41/20* (2021.01)

(52) U.S. Cl.
CPC ..... *F25B 41/20* (2021.01); *F25B 31/026* (2013.01); *F25B 2500/27* (2013.01); *F25B 2600/2519* (2013.01)

(58) Field of Classification Search
CPC .. F25B 5/02; F25B 6/02; F04D 27/002; F04D 29/442
See application file for complete search history.

(56) References Cited

U.S. PATENT DOCUMENTS

| | | | | |
|---|---|---|---|---|
| 7,905,702 | B2 * | 3/2011 | Stabley | F04D 27/001 415/118 |
| 10,378,553 | B2 * | 8/2019 | Sommer | F04D 29/058 |
| 2004/0109757 | A1 | 6/2004 | Nenstiel | |
| 2012/0103009 | A1 | 5/2012 | Ding et al. | |
| 2013/0064682 | A1 | 3/2013 | Sun et al. | |
| 2014/0328667 | A1 | 11/2014 | Sommer et al. | |
| 2016/0208809 | A1 | 7/2016 | Gonzalez | |
| 2019/0338785 | A1 | 11/2019 | Sommer et al. | |
| 2020/0018326 | A1 * | 1/2020 | Snell | F04D 17/10 |

OTHER PUBLICATIONS

European Office Action for EP Application No. 21760956.9, dated Feb. 15, 2024, 11 pages.
Korean Office Action for KR Application No. 10-2022-7033427, dated Apr. 12, 2024, 7 pages.
Chinese Office Action for CN Application No. 202180027735.1, dated Sep. 5, 2024, 11 pages.

* cited by examiner

SYSTEM AND METHOD FOR OPERATION OF VARIABLE GEOMETRY DIFFUSER AS CHECK VALVE

CROSS REFERENCE TO RELATED APPLICATION

This application is a U.S. National Stage Application of PCT International Application No. PCT/US2021/020049, entitled "SYSTEM AND METHOD FOR OPERATION OF VARIABLE GEOMETRY DIFFUSER AS CHECK VALVE." filed Feb. 26, 2021, which claims priority to and the benefit of U.S. Provisional Application No. 62/982,573, entitled "SYSTEM AND METHOD FOR OPERATION OF VARIABLE GEOMETRY DIFFUSER AS CHECK VALVE," filed Feb. 27, 2020, each of which is hereby incorporated by reference in its entirety for all purposes.

BACKGROUND

This application relates generally to vapor compression systems incorporated in air conditioning and refrigeration applications, and, more particularly, to flow control of refrigerant in a compressor.

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Vapor compression systems are utilized in residential, commercial, and industrial environments to control environmental properties, such as temperature and humidity, for occupants of the respective environments. The vapor compression system circulates a working fluid, typically referred to as a refrigerant, which changes phases between vapor, liquid, and combinations thereof in response to being subjected to different temperatures and pressures associated with operation of the vapor compression system. For example, the vapor compression system utilizes a compressor to circulate the refrigerant to a heat exchanger which may transfer heat between the refrigerant and another fluid flowing through the heat exchanger. Unfortunately, in certain conditions, refrigerant flow through the compressor may induce backspin in the compressor, which may cause undesirable wear and degradation on the compressor and related components.

SUMMARY

In an embodiment of the present disclosure, a compressor includes a diffuser passage configured to receive refrigerant flow from an impeller of the compressor, where the diffuser passage is at least partially defined by a compressor discharge plate of the compressor. The compressor also includes a variable geometry diffuser positioned within the diffuser passage and configured to adjust a dimension of a refrigerant flow path through the diffuser passage, an actuator coupled to the variable geometry diffuser and configured to adjust a position of the variable geometry diffuser within the diffuser passage, and a controller configured to regulate operation of the actuator. The controller is configured to instruct the actuator to adjust the position of the variable geometry diffuser from a first position to a second position using a first force and to adjust the position of the variable geometry diffuser from the second position to a third position using a second force less than the first force, where the variable geometry diffuser abuts the compressor discharge plate in the third position.

In another embodiment of the present disclosure a heating, ventilation, air conditioning, and refrigeration (HVAC&R) system includes a compressor configured to pressurize refrigerant within a refrigerant circuit, where the compressor includes a diffuser passage configured to receive the refrigerant from an impeller of the compressor. The HVAC&R system also includes a variable geometry diffuser of the compressor, where the variable geometry diffuser is configured to be positioned within the diffuser passage and is configured to adjust a dimension of a refrigerant flow path through the diffuser passage, an actuator configured to adjust a position of the variable geometry diffuser within the diffuser passage, and a controller configured to regulate operation of the actuator, where the controller is configured to control the actuator to position the variable geometry diffuser within the diffuser passage and against a compressor discharge plate during stoppage of the compressor.

In a further embodiment of the present disclosure, a heating, ventilation, air conditioning and refrigeration (HVAC&R) system controller includes a tangible, non-transitory, computer-readable medium storing computer-executable instructions that, when executed, are configured to cause processing circuitry to control an actuator to position a variable geometry diffuser in a diffuser passage of a compressor within a first range of positions during operation of the compressor, control the actuator to position the variable geometry diffuser in the diffuser passage of the compressor within a second range of positions during stoppage of the compressor, and control the actuator to maintain a position of the variable geometry diffuser within the diffuser passage and against a compressor discharge plate of the compressor during stoppage of the compressor.

DRAWINGS

Various aspects of this disclosure may be better understood upon reading the following detailed description and upon reference to the drawings in which FIG. 1 is a perspective view of an embodiment of a building that may utilize a heating, ventilation, air conditioning, and refrigeration (HVAC&R) system in a commercial setting, in accordance with an aspect of the present disclosure;

DETAILED DESCRIPTION

Figure 1:
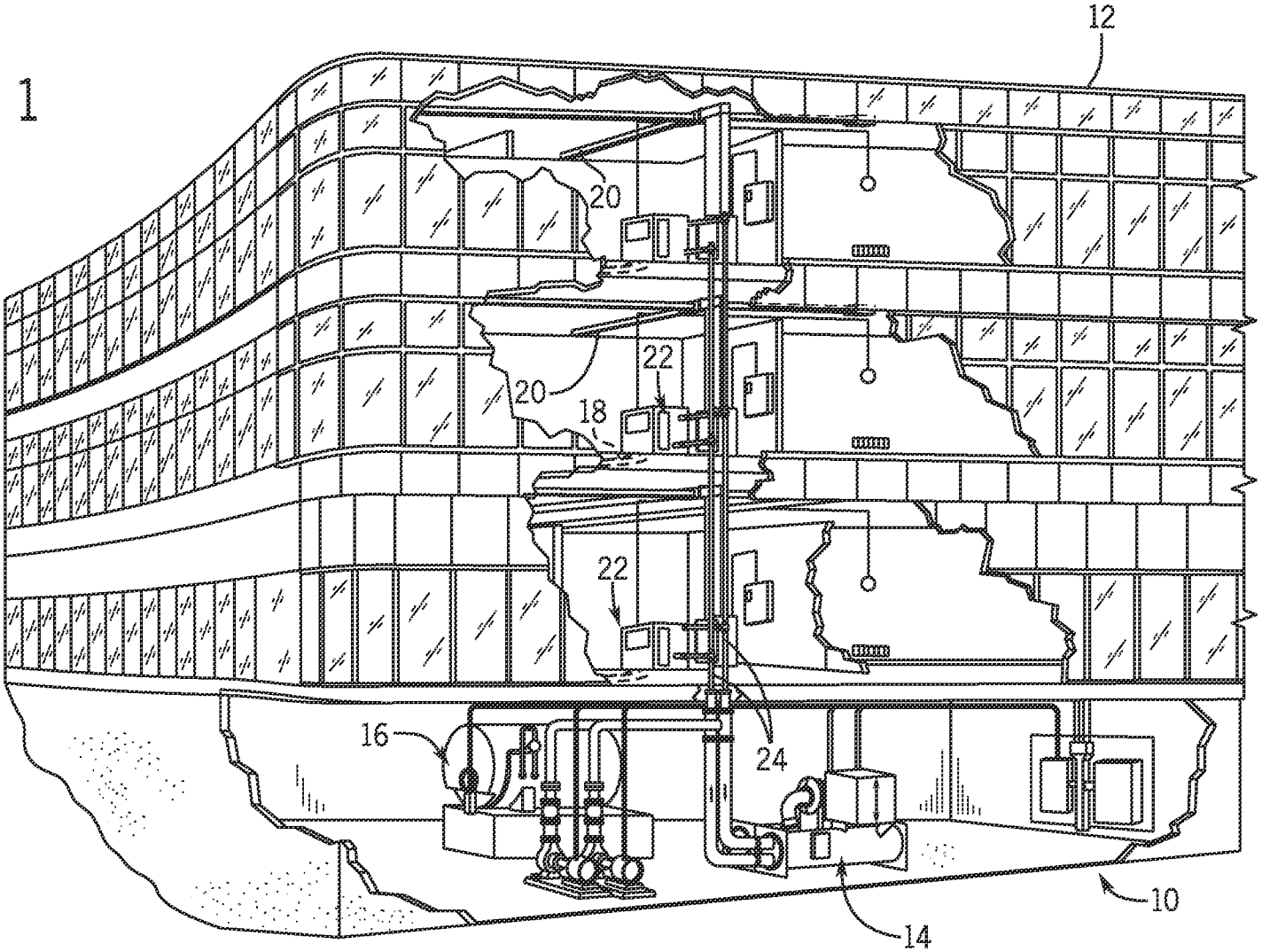

One or more specific embodiments of the present disclosure will be described below. These described embodiments are examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Embodiments of the present disclosure are directed toward a heating, ventilating, air conditioning, and refrigeration (HVAC&R) system configured to cool a conditioning fluid. For example, the HVAC&R system may receive a flow of the conditioning fluid, such as from air handling equipment or other terminal devices in a building, and cool the conditioning fluid. The HVAC&R system may then return the conditioning fluid to the air handling equipment for use in cooling or conditioning air in the building. The HVAC&R system may include a vapor compression system configured to cool a refrigerant and place the cooled refrigerant in a heat exchange relationship with the conditioning fluid to absorb heat or thermal energy from the conditioning fluid. In general, the vapor compression system includes a refrigerant circuit configured to circulate the refrigerant through one or more heat exchangers, such as a condenser and an evaporator. The vapor compression system also includes a compressor (e.g., centrifugal compressor) to circulate the refrigerant through the refrigerant circuit. In some embodiments, the HVAC&R system is a chiller system, such as a water-cooled chiller system or air-cooled chiller system.

Unfortunately, in certain conditions, the compressor may be susceptible to spin (e.g., backspin) due to flow of the refrigerant through the refrigerant circuit. For example, when operation of a chiller system is suspended, the conditioning fluid (e.g., water) may still flow through the evaporator and/or a cooling fluid (e.g., water) may still flow through the condenser disposed along the refrigerant circuit. The temperature of the water may cause boiling of refrigerant in the condenser and/or condensing of the refrigerant in the evaporator. As a result, natural refrigerant migration through the refrigerant circuit (e.g., from the condenser to the evaporator via the compressor) may be induced, which may cause undesirable spin (e.g., backspin) of the compressor.

The compressor may also be susceptible to spin or backspin via refrigerant flow in embodiments of the chiller system having multiple refrigerant circuits (e.g., in a series counter-flow arrangement), and therefore multiple compressors, when one of the refrigerant circuits is idle or not operating. As will be appreciated, spin or backspin of a non-operating compressor can cause wear and degradation to the motor of the non-operating compressor. Additionally, bearing support systems (e.g., oil pumps, magnetic bearings, etc.) of the non-operating compressor may also be inactive, thereby exposing the non-operating compressor and/or the bearing support systems to premature wear and degradation during instances of compressor spin or backspin. Unfortunately, conventional systems and methods to reduce compressor spin or backspin, such as automated discharge isolation valves, are expensive.

Accordingly, embodiments of the present disclosure are directed to systems and methods for utilizing a variable geometry diffuser (VGD), such as a variable geometry diffuser ring, as a flow check valve to substantially reduce, block, or prevent undesirable refrigerant flow across the compressor and thereby mitigate spin and/or backspin of the compressor. Specifically, present embodiments include an actuator and/or actuation system (e.g., a two-stage actuator) configured to operate in multiple modes to actuate and move the VGD within a diffuser passage of the compressor. For example, the actuator may be configured to operate in a first mode by applying a first force to move the VGD and to operate in a second mode by applying a second force that is less than the first force to move the VGD. In accordance with present techniques, a control system is configured to selectively regulate operation of the actuator between the first mode and the second mode, for example, based on an operational state of the compressor and/or based on a position of the VGD within the diffuser passage. The control system may operate the actuator in the first mode when the compressor is operating in order to move the VGD within the diffuser passage and adjust a size of a flow path (e.g., refrigerant flow path) through the diffuser passage, such as for surge or capacity control of the compressor. The control system may operate the actuator in the second mode when the compressor is not operating, during a fault sequence, and/or during a shutdown sequence in order to move the VGD within the diffuser passage and abut an opposing surface of the diffuser passage, thereby substantially completely blocking or closing the flow path through the diffuser passage. In this way, the VGD may block or prevent refrigerant flow through the compressor so as to reduce spin and backspin of the compressor when the compressor is not operating. Details of the operation of the control system and the actuator are discussed in further detail below.

It should be noted that the disclosure herein describes the present techniques used with a VGD ring of a compressor. However, the present techniques may also be utilized in embodiments of a compressor that utilize other types of VGDs, such as variable vane diffusers, variable wall diffusers, or other types of diffusers. Moreover, the discussion below describes the present techniques implemented in a water-cooled chiller system, but the systems and methods disclosed herein may also be implemented in other HVAC&R systems.

Turning now to the drawings, FIG. 1 is a perspective view of an embodiment of an environment for a heating, ventilation, air conditioning, and refrigeration (HVAC&R) system 10 in a building 12 for a typical commercial setting. The HVAC&R system 10 may include a vapor compression system 14 that supplies a chilled liquid, which may be used to cool the building 12. The HVAC&R system 10 may also include a boiler 16 to supply warm liquid to heat the building 12 and an air distribution system which circulates air through the building 12. The air distribution system can also include an air return duct 18, an air supply duct 20, and/or an air handler 22. In some embodiments, the air handler 22 may include a heat exchanger that is connected to the boiler 16 and the vapor compression system 14 by conduits 24. The heat exchanger in the air handler 22 may receive either heated liquid from the boiler 16 or chilled liquid from the vapor compression system 14, depending on the mode of operation of the HVAC&R system 10. The HVAC&R system 10 is shown with a separate air handler on each floor of building 12, but in other embodiments, the HVAC&R system 10 may include air handlers 22 and/or other components that may be shared between or among floors.

Figure 2:
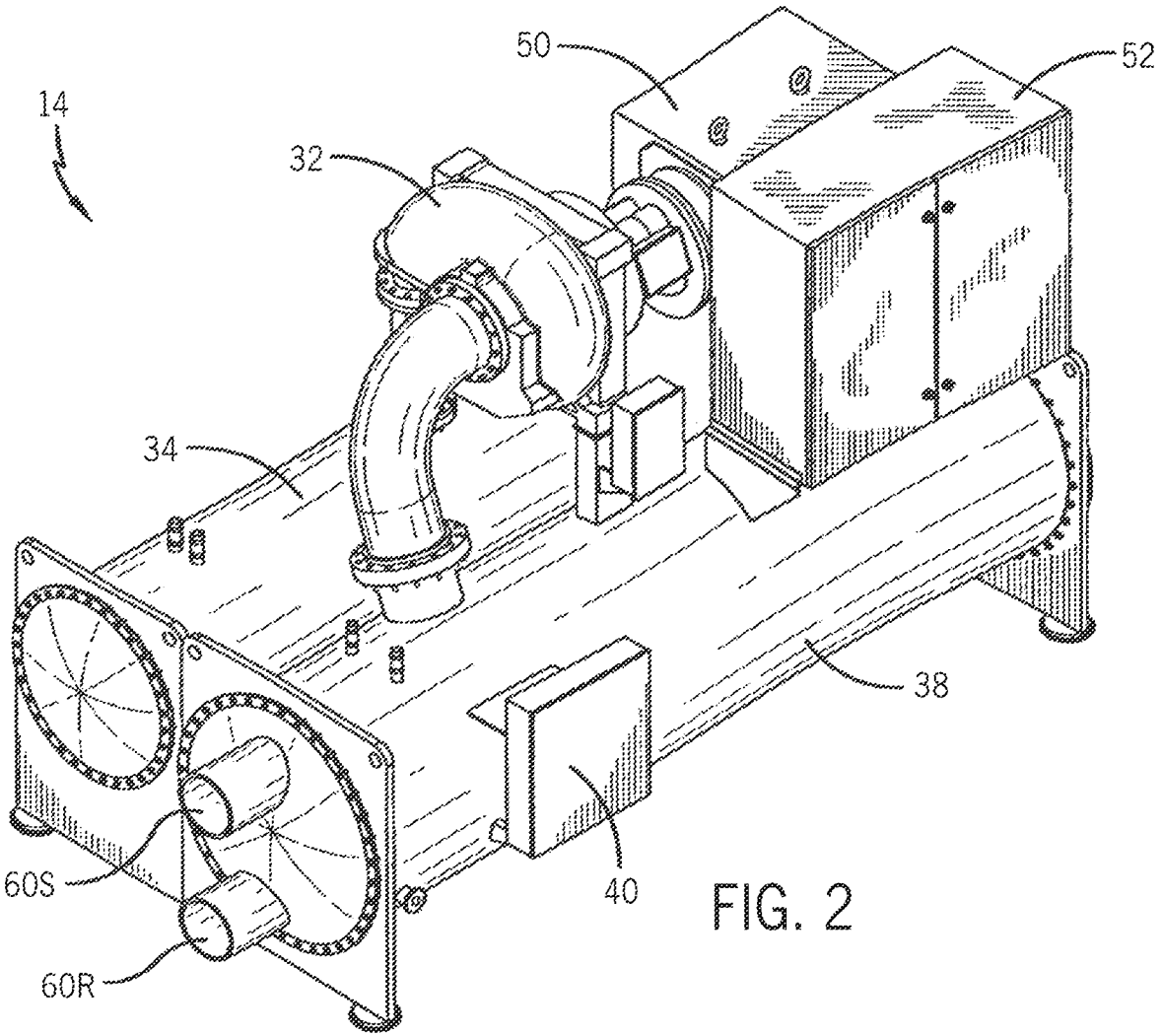
FIG. 2 is a perspective view of an embodiment of a vapor compression system, in accordance with an aspect of the present disclosure.
Figure 3:
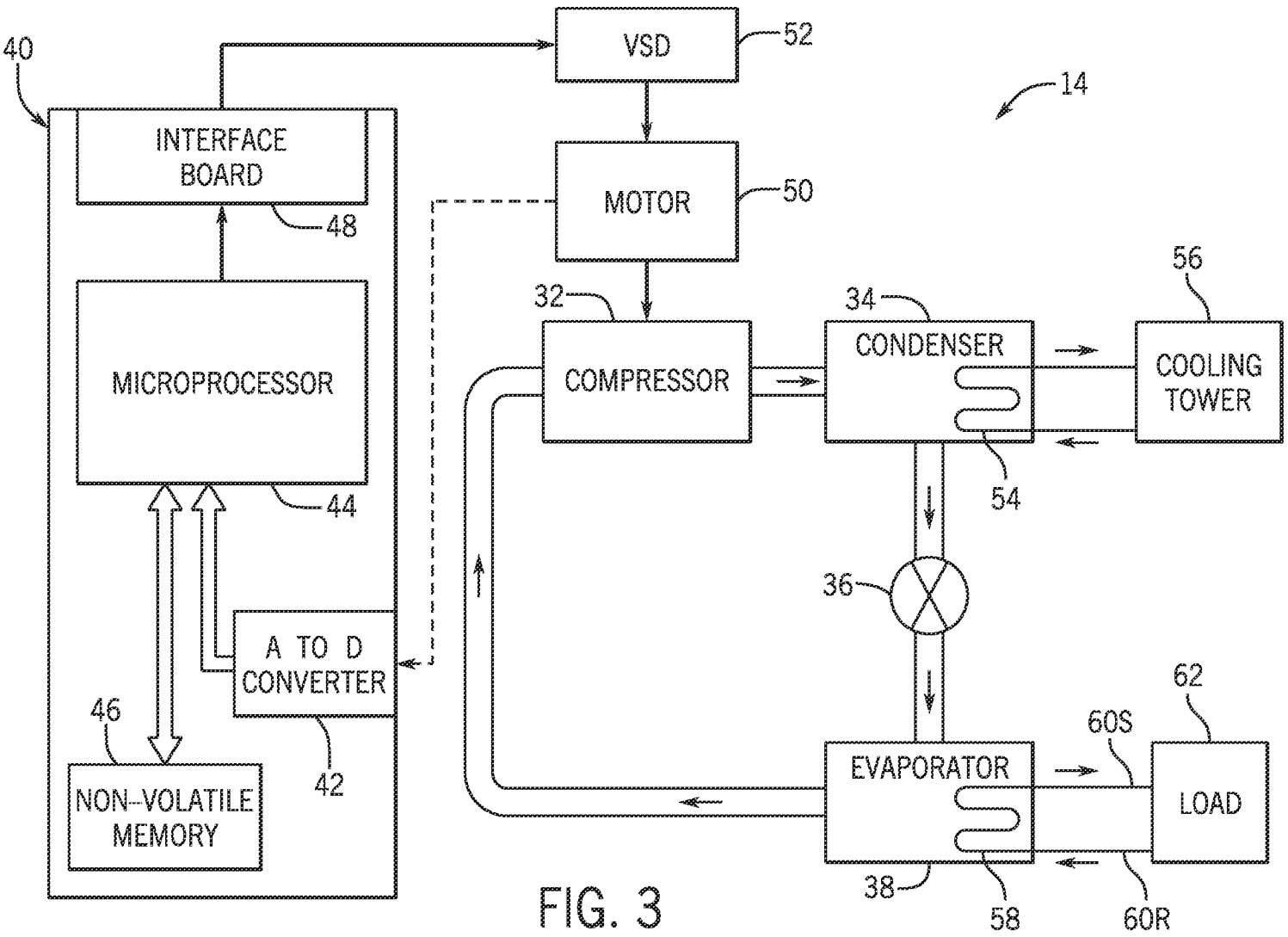
FIG. 3 is a schematic of an embodiment of a vapor compression system, in accordance with an aspect of the present disclosure.

FIGS. 2 and 3 illustrate embodiments of the vapor compression system 14 that can be used in the HVAC&R system 10. The vapor compression system 14 may circulate a refrigerant through a circuit (e.g., a refrigerant loop) starting with a compressor 32. The circuit may also include a condenser 34, an expansion valve(s) or device(s) 36, and a liquid chiller or an evaporator 38. The vapor compression system 14 may further include a control panel 40 that has an analog to digital (A/D) converter 42, a microprocessor 44, a non-volatile memory 46, and/or an interface board 48.

Some examples of fluids that may be used as refrigerants in the vapor compression system 14 are hydrofluorocarbon (HFC) based refrigerants, for example, R-410A, R-407, R-134a, hydrofluoro olefin (HFO), "natural" refrigerants like ammonia (NH3), R-717, carbon dioxide (CO2), R-744, or hydrocarbon based refrigerants, water vapor, or any other suitable refrigerant. In some embodiments, the vapor compression system 14 may be configured to efficiently utilize refrigerants having a normal boiling point of about 19 degrees Celsius (66 degrees Fahrenheit) at one atmosphere of pressure, also referred to as low pressure refrigerants, versus a medium pressure refrigerant, such as R-134a. As used herein, "normal boiling point" may refer to a boiling point temperature measured at one atmosphere of pressure.

In some embodiments, the vapor compression system 14 may use one or more of a variable speed drive (VSDs) 52, a motor 50, the compressor 32, the condenser 34, the expansion valve or device 36, and/or the evaporator 38. The motor 50 may drive the compressor 32 and may be powered by a variable speed drive (VSD) 52. The VSD 52 receives alternating current (AC) power having a particular fixed line voltage and fixed line frequency from an AC power source, and provides power having a variable voltage and frequency to the motor 50. In other embodiments, the motor 50 may be powered directly from an AC or direct current (DC) power source. The motor 50 may include any type of electric motor that can be powered by a VSD or directly from an AC or DC power source, such as a switched reluctance motor, an induction motor, an electronically commutated permanent magnet motor, or another suitable motor.

The compressor 32 compresses a refrigerant vapor and delivers the vapor to the condenser 34 through a discharge passage. In some embodiments, the compressor 32 may be a centrifugal compressor. The refrigerant vapor delivered by the compressor 32 to the condenser 34 may transfer heat to a cooling fluid (e.g., water or air) in the condenser 34. The refrigerant vapor may condense to a refrigerant liquid in the condenser 34 as a result of thermal heat transfer with the cooling fluid. The liquid refrigerant from the condenser 34 may flow through the expansion device 36 to the evaporator 38. In the illustrated embodiment of FIG. 3, the condenser 34 is water cooled and includes a tube bundle 54 connected to a cooling tower 56, which supplies the cooling fluid to the condenser 34.

The liquid refrigerant delivered to the evaporator 38 may absorb heat from another cooling fluid (e.g., a conditioning fluid), which may or may not be the same cooling fluid used in the condenser 34. The liquid refrigerant in the evaporator 38 may undergo a phase change from the liquid refrigerant to a refrigerant vapor. As shown in the illustrated embodiment of FIG. 3, the evaporator 38 may include a tube bundle 58 having a supply line 60S and a return line 60R connected to a cooling load 62. The conditioning fluid of the evaporator 38 (e.g., water, ethylene glycol, calcium chloride brine, sodium chloride brine, or any other suitable fluid) enters the evaporator 38 via return line 60R and exits the evaporator 38 via supply line 60S. The evaporator 38 may reduce the temperature of the conditioning fluid in the tube bundle 58 via thermal heat transfer with the refrigerant. The tube bundle 58 in the evaporator 38 can include a plurality of tubes and/or a plurality of tube bundles. In any case, the vapor refrigerant exits the evaporator 38 and returns to the compressor 32 by a suction line to complete the cycle.

Figure 4:
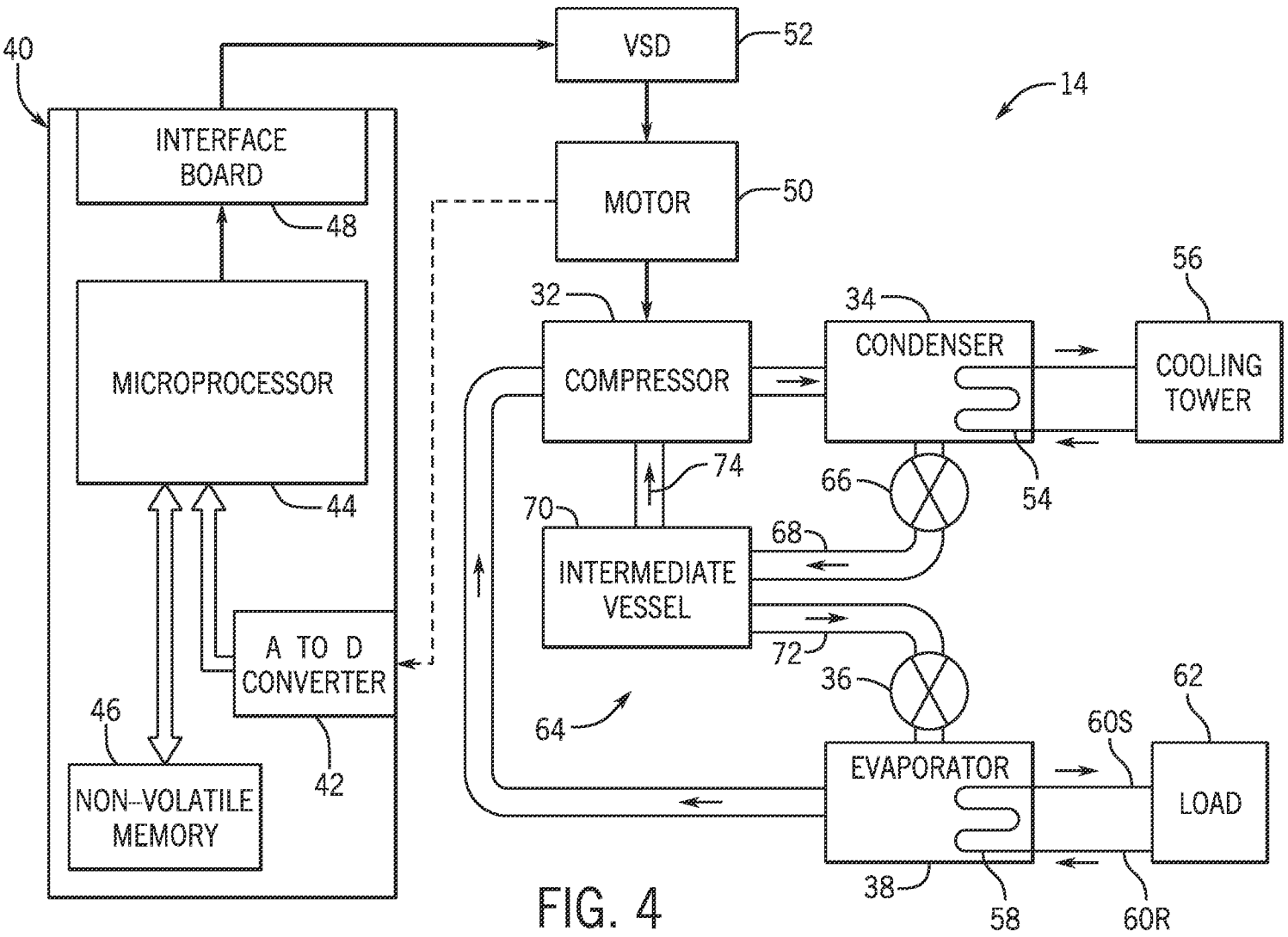
FIG. 4 is a schematic of an embodiment of a vapor compression system, in accordance with an aspect of the present disclosure.

FIG. 4 is a schematic of an embodiment of the vapor compression system 14 with an intermediate circuit 64 incorporated between condenser 34 and the expansion device 36. The intermediate circuit 64 may have an inlet line 68 that is directly fluidly connected to the condenser 34. In other embodiments, the inlet line 68 may be indirectly fluidly coupled to the condenser 34. As shown in the illustrated embodiment of FIG. 4, the inlet line 68 includes a first expansion device 66 positioned upstream of an intermediate vessel 70. In some embodiments, the intermediate vessel 70 may be a flash tank (e.g., a flash intercooler). In other embodiments, the intermediate vessel 70 may be configured as a heat exchanger or a "surface economizer." In the illustrated embodiment of FIG. 4, the intermediate vessel 70 is used as a flash tank, and the first expansion device 66 is configured to lower the pressure of (e.g., expand) the liquid refrigerant received from the condenser 34. During the expansion process, a portion of the liquid may vaporize, and thus, the intermediate vessel 70 may be used to separate the vapor from the liquid received from the first expansion device 66. Additionally, the intermediate vessel 70 may provide for further expansion of the liquid refrigerant due to a pressure drop experienced by the liquid refrigerant when entering the intermediate vessel 70 (e.g., due to a rapid increase in volume experienced when entering the intermediate vessel 70). The vapor in the intermediate vessel 70 may be drawn by the compressor 32 through a suction line 74 of the compressor 32. In other embodiments, the vapor in the intermediate vessel may be drawn to an intermediate stage of the compressor 32 (e.g., not the suction stage). The liquid that collects in the intermediate vessel 70 may be at a lower enthalpy than the liquid refrigerant exiting the condenser 34 due to the expansion in the expansion device 66 and/or the intermediate vessel 70. The liquid from intermediate vessel 70 may then flow in line 72 through a second expansion device 36 to the evaporator 38.

Figure 5:
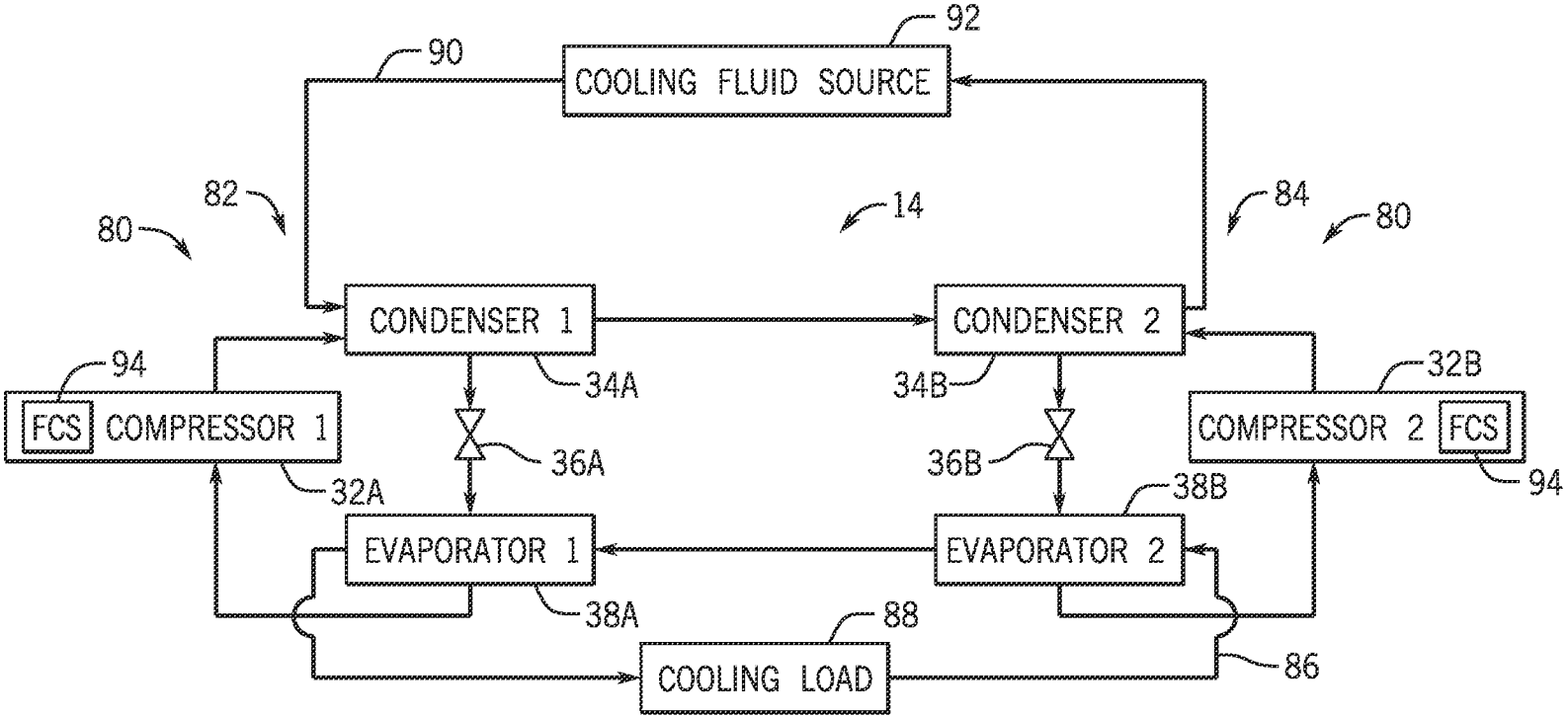
FIG. 5 is a schematic of an embodiment of a vapor compression system having multiple refrigerant circuits in a series counter-flow arrangement, in accordance with an aspect of the present disclosure.

As mentioned above, the systems and methods disclosed herein may be utilized in HVAC&R systems 10 and/or vapor compression systems 14 having multiple refrigerant circuits. For example, FIG. 5 is a schematic of an embodiment of the vapor compression system 14 with multiple refrigerant circuits 80 (e.g., refrigerant loops). In particular, the illustrated embodiment includes a first refrigerant circuit 82 and a second refrigerant circuit 84 arranged in a series counter-flow arrangement. The first refrigerant circuit 82 includes a first compressor 32A, a first condenser 34A, a first expansion device 36A, and a first evaporator 38A. The second refrigerant circuit 84 includes a second compressor 32B, a second condenser 34B, a second expansion device 36B, and a second evaporator 38B. Each of the refrigerant circuits 80 is configured to circulate a respective refrigerant therethrough and is configured to operate in a manner similar to that described above with reference to the vapor compression system 14 shown in FIGS. 2-4. It should be noted that each of the refrigerant circuits 80 may also include components in addition to those shown in FIGS. 2-4.

In the illustrated embodiment, the first and second refrigerant circuits 82 and 84 of the vapor compression system 14 are arranged in a series counter-flow arrangement. Specifically, the first and second evaporators 38A and 38B define a portion of a conditioning fluid flow path or circuit 86 that extends from a cooling load 88 (e.g., air handlers 22), sequentially through the second evaporator 38B and the first evaporator 38A, and back to the cooling load 88. Similarly, the first and second condensers 34A and 34B define a portion of a cooling fluid flow path or circuit 90 that extends from a cooling fluid source 92 (e.g., cooling tower 56), sequentially through the first condenser 34A and the second condenser 34B, and back to the cooling fluid source 92. Thus, conditioning fluid is directed through the vapor compression system 14 first through the second evaporator 38B and then through the first evaporator 38A, while cooling fluid is directed through the vapor compression system 14 first through the first condenser 34A and then through the second condenser 34B, thereby providing the series counter-flow arrangement.

In some circumstances, one of the refrigerant circuits 80 may be in an operating state, while the other of the refrigerant circuits 80 may be in a non-operating state. As will be appreciated, the compressor 32 of the refrigerant circuit 80 that is not operating may be idle (e.g., the motor 50 associated with the compressor 32 is not powered or energized). Thus, the compressor 32 of the non-operating refrigerant circuit 80 does not operate to circulate refrigerant through the non-operating refrigerant circuit 80. Nevertheless, the non-operating refrigerant circuit 80 may still be susceptible to natural refrigerant migration therethrough. For example, if the first refrigerant circuit 82 is in an operating state and the second refrigerant circuit 84 is in a non-operating state, cooling fluid may still circulate through the second condenser 34B along the cooling fluid circuit 90 (e.g., from the first condenser 34A, through the second condenser 34B, and to the cooling fluid source 92). Similarly, conditioning fluid may still circulate through the second evaporator 38B along the conditioning fluid circuit 86 (e.g., from the cooling load 88, through the second evaporator 38B, and to the first evaporator 38A). In some circumstances, the flow of cooling fluid through the second condenser 34B and/or the flow of conditioning fluid through the second evaporator 38B may induce natural refrigerant migration through the second refrigerant circuit 84. As discussed above, natural refrigerant migration may induce undesirable spin or backspin in the second compressor 32B that is not operating.

Accordingly, present embodiments include a flow control system 94 configured to improve operation and control of the compressor 32, such as by reducing, blocking, and/or preventing undesirable spin and/or backspin of the compressor 32. As described in further detail below, the flow control system 94 may be incorporated with (e.g., integrated with) the compressor 32 (e.g., one or both of compressors 32A, 32B) and may include a variable geometry diffuser (VGD) of the compressor 32, an actuation system configured adjust a position of the VGD within the compressor 32, and a control system configured to control operation of the actuation system. In some applications, the VGD is utilized to adjust a flow path through a diffuser passage of the compressor 32 in order enable surge and/or capacity control of the compressor 32 during operation of the compressor 32. Additionally, the VGD may be controlled via the actuation system and control system to position the VGD within the diffuser passage to completely or substantially completely block the flow path through the diffuser passage by positioning the VGD against an opposing wall of the diffuser passage and thus block refrigerant flow through the diffuser passage when the compressor 32 is not operating. In this way, the VGD may function as a flow check valve to mitigate or reduce spin and/or backspin of the compressor 32 that may be caused by natural refrigerant migration when the compressor 32 is not operating. As discussed in further detail below; the actuation system is configured to move the VGD within the diffuser passage for capacity and/or surge control using a first force and to move the VGD within the diffuser passage to abut the opposing surface and completely block the flow path through the diffuser passage using a second force that is less than the first force.

Figure 6:
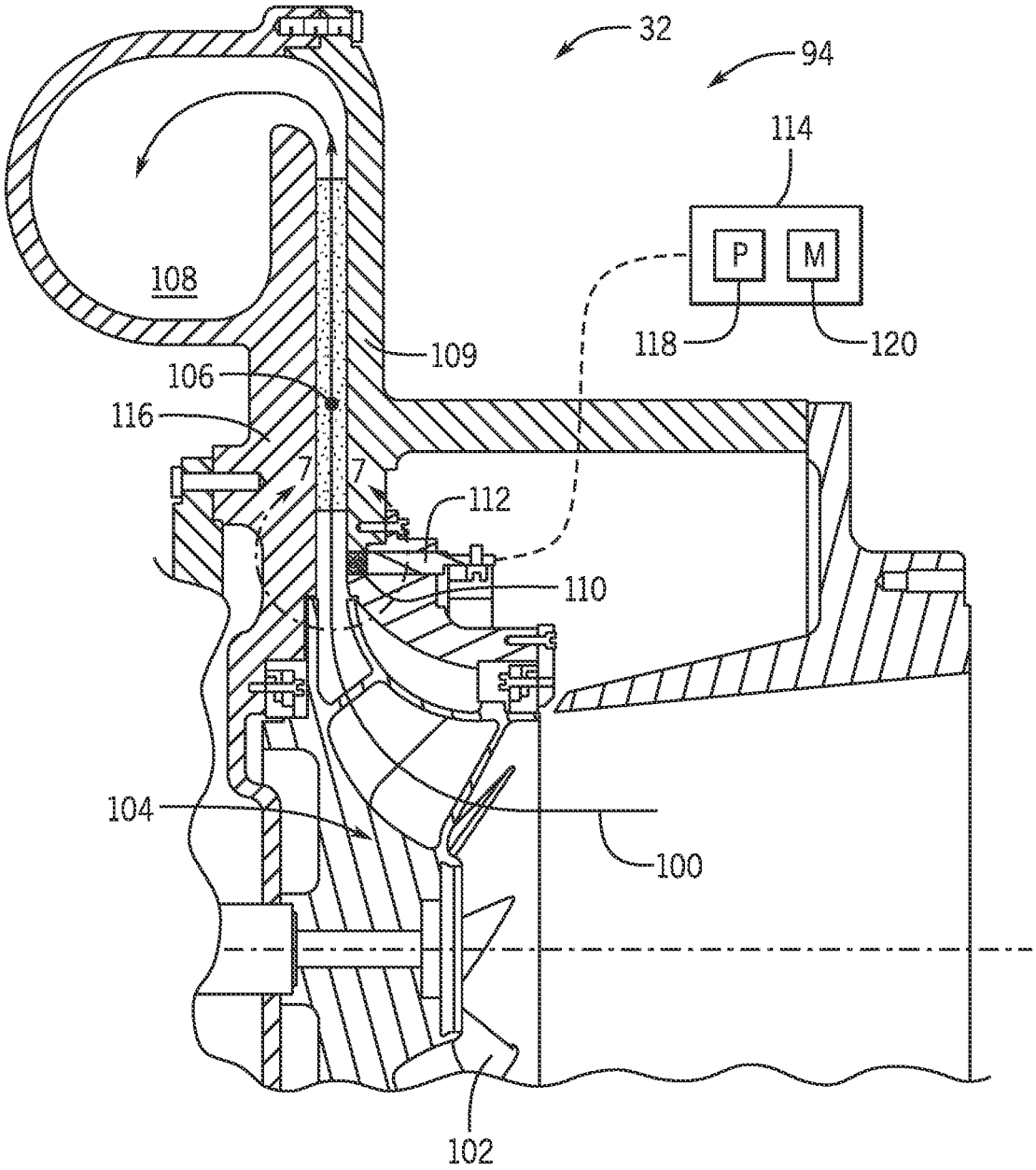
FIG. 6 is a cross-section of an embodiment of a portion of a compressor having a variable geometry diffuser that may be included in the systems of FIGS. 1-5, in accordance with an aspect of the present disclosure.

FIG. 6 is a cross-section of an embodiment of a portion of the compressor 32 which may be included in any of the systems described with reference to FIGS. 1-5 or in any other suitable HVAC&R system 10. A refrigerant flow path 100 is illustrated through the compressor 32, whereby refrigerant travels through blades 102 of an impeller 104 of the compressor 32, toward a diffuser passage 106 defined by and extending between a nozzle base plate 109 (e.g., compressor casing) and a compressor discharge plate 116 (e.g., diffuser plate) From the diffuser passage 106, the refrigerant is directed into a collector 108 (e.g., volute). The blades 102 of the impeller 104 rotate (e.g., via operation of the motor 50) to accelerate the refrigerant outwardly from a center of rotation of the impeller 104. The accelerated refrigerant may travel along the illustrated refrigerant flow path 100 toward the diffuser passage 106, which is designed to convert kinetic energy of the refrigerant into pressure, for example, by gradually reducing a velocity of the refrigerant.

As noted above, the compressor 32 may include the flow control system 94 to regulate refrigerant flow through the compressor 32. The flow control system 94 may include a variable geometry diffuser (VGD) 110 disposed in, or proximate to, a lower portion of the diffuser passage 106 (e.g., between the impeller 104 and the collector 108 and proximate the impeller 104), an actuator 112, and a controller 114 (e.g., a control system). For example, the VGD 110 may be positioned at least partially within or adjacent the nozzle base plate 109 (e.g., within a groove formed in the nozzle base plate 109). In the illustrated embodiment, the VGD 110 is a VGD ring. However, in other embodiments, the VGD 110 may be a variable vane diffuser, a variable wall diffuser, or other type of variable diffuser. The position of the VGD 110 within the diffuser passage 106 is adjustable in order to improve control and operation of the compressor 32. For example, the VGD 110 may be coupled to the actuator 112 (e.g., a two-stage actuator, an actuation system, etc.), which, upon instruction by the controller 114 (e.g., a control system), actuates or moves the VGD 110 from a previous position to a desired position. In some embodiments, the actuator 112 may be an electromechanical actuator, a magnetic actuator, a hydraulic actuator, or any other suitable type of actuator. As described herein, the flow control system 94 (e.g., the actuator 112 and/or the controller 114) is configured to operate in two or more stages or modes. For example, the actuator 112 may actuate the VGD 110 in a first stage or mode (e.g., high torque mode) by applying a first force to the VGD 110 and in a second stage or mode (e.g., low torque mode) by applying a second force to the VGD 110 that is less than the first force.

The controller 114 may control the position of the VGD 110 such that the VGD 110 adjusts a size of a flow path through the diffuser passage 106. For example, the controller 114 may control operation of the actuator 112 to increase or decrease a size of the flow path (e.g., refrigerant flow path 100) through the diffuser passage 106 without completely blocking the flow path through the diffuser passage 106 during operation of the compressor 32 (e.g., to control surge and/or capacity of the compressor 32). The controller 114 may also control operation of the actuator 112 to position the VGD 110 within the entire diffuser passage 106, such that the VGD 110 abuts the compressor discharge plate 116 (e.g., a diffuser plate) of the compressor 32, thereby completely blocking the diffuser passage 106 and preventing flow of refrigerant therethrough. In this manner, the VGD 110 is used as a flow check valve to mitigate or prevent spin and/or backspin (e.g., of the impeller 100), such as during non-operational periods or stoppage of the compressor 32.

The controller 114 may include processing circuitry 118 and a memory 120. The memory 120 may include a tangible, non-transitory, computer-readable medium that may store instructions that, when executed by the processing circuitry 118, may cause the processing circuitry 118 to perform various functions or operations described herein. To this end, the processing circuitry 118 may be any suitable type of computer processor or microprocessor capable of executing computer-executable code, including but not limited to one or more field programmable gate arrays (FPGA), application-specific integrated circuits (ASIC), programmable logic devices (PLD), programmable logic arrays (PLA), and the like. For example, the controller 114 may control an operating capacity of the compressor 32 based at least in part on certain operating and/or environmental conditions (e.g., refrigerant temperature). The controller 114 may also include data stored on the memory 120 indicating a desired position of the VGD 110 based on the operating capacity of the compressor 32. Further, the controller 114 may be configured to control a stage or actuating force of the actuator 112 based on a position of the VGD 110 within the diffuser passage 106 and/or based on an operational state of the compressor 32. For example, the controller 114 may control the actuator 112 to adjust a position of the VGD 110 using a first force or torque when the VGD 110 is within a first range of positions within the diffuser passage 106 and using a second force or torque, less than the first force or torque, when the VGD 110 is within a second range of positions within the diffuser passage 106. Control of the VGD 110 via the actuator 112 and the controller 114 is described in further detail below.

Figure 7:
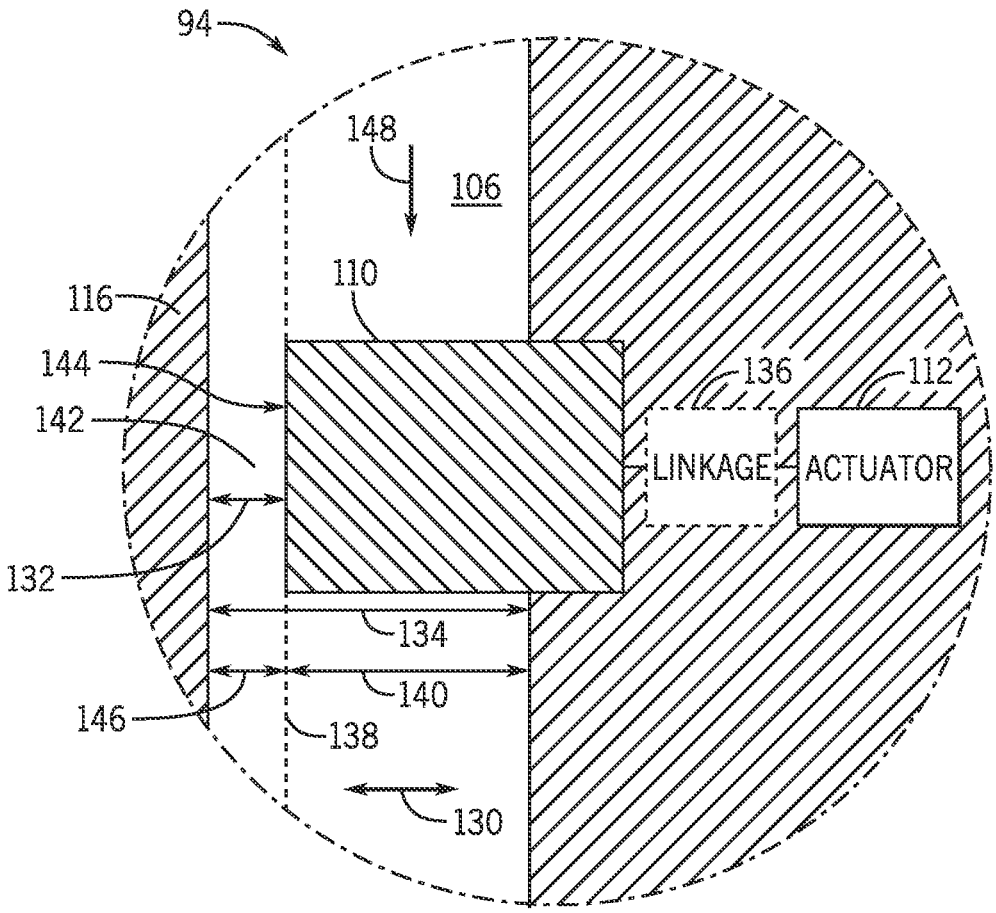
FIG. 7 is a schematic of an embodiment of a portion of a variable geometry diffuser in a compressor, in accordance with an aspect of the present disclosure.

FIG. 7 is a cross-section of an embodiment of a portion of the compressor 32 of FIG. 6 having the VGD 110 in a partially blocking position. As shown in FIGS. 6 and 7, the VGD 110 is generally configured to travel within the diffuser passage 106 along a direction 130 (e.g., axis) and, as shown in FIG. 7, may restrict a portion (e.g., a flow path) of the diffuser passage 106 to a width 132 (e.g., dimension) that is less than a total width 134 (e.g., dimension) of the diffuser passage 106. As discussed, the actuator 112 is configured to actuate and move the VGD 110 within the diffuser passage 106 to, for example, adjust a size of the width 132 of the diffuser passage 106 through which refrigerant may flow. In some embodiments, the actuator 112 may be coupled to the VGD 110 via a linkage 136, such as a mechanical linkage, configured to transfer force applied by the actuator 112 to the VGD 110.

In the illustrated embodiment, the VGD 110 is shown in a home or "zero" position 138. For example, the home position 138 of the VGD 110 may be a threshold position (e.g., a lower threshold position) within the diffuser passage 106 beyond which the actuator 112 and/or controller 114 does not adjust the VGD 110 (e.g., further into the diffuser passage 106 and/or further towards the compressor discharge plate 116) during operational periods of the compressor 32. In other words, when the compressor 32 is operating, the actuator 112 and/or controller 114 is configured to move the VGD 110 within a first range of positions 140 in the diffuser passage 106 and does not position the VGD 110 beyond the home position 138 (e.g., closer to the compressor discharge plate 116). Thus, when the compressor 32 is operating, a gap 142 remains between a distal surface 144 of the VGD 110 and the compressor discharge plate 116, where a dimension (e.g., width) of the gap 142 from the distal surface 144 to the compressor discharge plate 116 is greater than or equal to the width 132 shown in FIG. 7. As will be appreciated, the presence of the gap 142 allows for thermal growth of the VGD 110 and blocks contact between the VGD 110 and the compressor discharge plate 116 during operation of the compressor 32 that may otherwise cause undesirable transfer of force to the linkage 136 or other components of the compressor 32.

In accordance with present embodiments, the actuator 112 and/or controller 114 is also configured to selectively move the VGD 110 beyond the home position 138 and into contact with the compressor discharge plate 116. For example, during stoppage (e.g., non-operating periods, a fault sequence, and/or a shutdown sequence) of the compressor 32, the controller 114 may instruct the actuator 112 to move the VGD 110 beyond the home position 138 (e.g., further away from the nozzle base plate 109), such that the VGD 110 contacts the compressor discharge plate 116 to block (e.g., completely block) the discharge passage 106 and thereby block or prevent refrigerant flow through the discharge passage 106. In other words, during non-operational periods, a fault sequence, and/or a shutdown sequence of the compressor 32, the controller 114 may instruct the actuator 112 to move the VGD 110 within a second range of positions 146, such that the VGD 110 is positioned beyond the home position 128 (e.g., relative to the nozzle base plate 109). As illustrated in FIG. 7, the first range of positions 140 and the second range of positions 146 may cooperatively extend across (e.g., equal) the total width 134 of the diffuser passage 106. In certain embodiments, the first range of positions 140 and the second range of positions 146 do not overlap with one another and are separated by the home position 138. By positioning the VGD 110 within the second range of positions 146 (e.g., in abutment with the compressor discharge plate 116), the VGD 110 may function as a flow check valve that does not allow natural migration of the refrigerant through the compressor 32 (e.g., from the condenser 34 to the evaporator 38 and/or in a direction 148) that may be induced when the compressor 32 is not operating.

As mentioned above, the flow control system 94 (e.g., the actuator 112) is configured to operate in two or more modes or stages. In a first mode or stage, the controller 114 may control the actuator 112 to adjust the position of the VGD 110 by applying a first force or torque (e.g., a large force and/or a force above a threshold amount) to the VGD 110, and in the second mode or stage the controller 114 may control the actuator 112 to adjust the position of the VGD 110 by applying a second force or torque (e.g., a small force and/or a force below a threshold amount) to the VGD 110 that is less than the first force or torque. For example, the controller 114 may be configured to instruct the actuator 112 to operate in the first mode or stage when the VGD 110 is within the first range of positions 140 and to instruct the actuator 112 to operate in the second mode or stage when the VGD 110 is within the second range of positions 146. By utilizing the first or large force to move the VGD 110 across the first range of positions 140 when the compressor 32 is operating, a position of the VGD 110 may be quickly and effectively adjusted during operation of the compressor 32 to control surge and/or capacity. By utilizing the second or small force to move the VGD 110 across the second range of positions 146 when the compressor 32 is not operating, the VGD 110 may be positioned to contact the compressor discharge plate 116, and therefore block natural refrigerant migration through the diffuser passage 106, while avoiding transfer of undesirable forces to the VGD 110, the linkage 136, the actuator 112, or other components of the compressor 32.

As an example, the compressor 32 may operate with the VGD 110 positioned in the diffuser passage 106 within the first range of positions 140, and the controller 114 may receive an indication (e.g., feedback) of a fault or shutdown of the compressor 32 (e.g., from the control board 40). To this end, the controller 114 may be communicatively coupled to other control components of the vapor compression system 14 and/or HVAC&R system 10 that regulate system operations. Based on the indication, the controller 114 may instruct the actuator 112 to adjust the position of the VGD 110 to the home position 138 in the first mode or stage of the actuator 112 (e.g., using the first or large force). Once the VGD 110 reaches the home position 138, the controller 114 may instruct the actuator 112 to adjust the position of the VGD 110 from the home position 138 to a position in contact with the compressor discharge plate 116 in the second mode or stage of the actuator 112 (e.g., using the second or small force). As discussed further below, once the VGD 110 is in sufficient contact with the compressor discharge plate 116, the controller 116 may instruct the actuator 112 to maintain the position of the VGD 110 against the compressor discharge plate 116 to block or prevent refrigerant flow through the discharge passage 106. For example, the actuator 112 may maintain the position of the VGD 110 in contact with the compressor discharge plate 116 until a command to operate the compressor 32 or to unblock the diffuser passage 106 is received by the controller 114 (e.g., from the control board 40).

Figure 8:
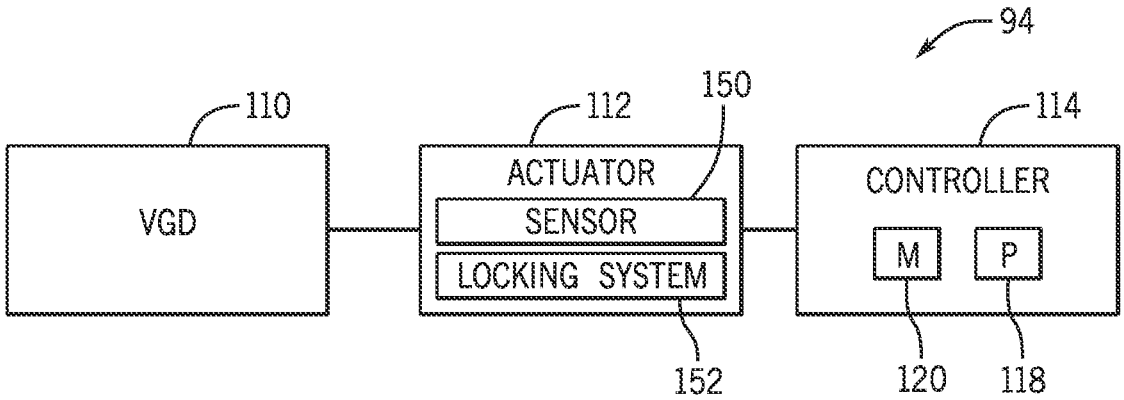
FIG. 8 is a schematic of an embodiment of a control system for a variable geometry diffuser, in accordance with an aspect of the present disclosure.

FIG. 8 is a schematic of the flow control system 94 including the controller 114, the actuator 112, and the VGD 110 and illustrating additional features that may be incorporated with systems utilizing the disclosed techniques. For example, the actuator 112 includes a sensor 150 and a locking system 152. The sensor 150 is configured to detect an operating parameter of the actuator 112 and may communicate the feedback indicative of the operating parameter to the controller 114. For example, in one embodiment, the actuator 112 may be an electromechanical motor, and the sensor 150 may be configured to detect a torque acting on the motor (e.g., acting on a shaft of the motor coupled to the VGD 110). The controller 114 may reference the torque feedback from the sensor 150 to determine when the VGD 110 is positioned in sufficient contact with the compressor discharge plate 116 to block refrigerant flow through the discharge passage 106. As discussed above, the controller 114 may also be configured to receive input and/or feedback from other components (e.g., control board 40) and may operate the actuator 112 based on the feedback. In some embodiments, the input and/or feedback may be indicative of an operating mode or capacity of the compressor 32, vapor compression system 14, and/or HVAC&R system 10.

When the controller 114 determines that the VGD 110 is positioned in sufficient contact with the compressor discharge plate 116 (e.g., based on feedback from the sensor 150), the controller 114 may instruct the actuator 112 to activate the locking system 152 to maintain the position of the VGD 110 within the diffuser passage 106 and may discontinue operation of the actuator 112 to move the VGD 110. In some embodiments, the locking system 152 may include a mechanical locking system configured to maintain a position of the actuator 112 and the VGD 110. The mechanical locking system may include, for example, a mechanical interlocking device, a key, a pin, a tapered ring, a spring lock, a brake mechanism, a piston, another suitable locking device, or any combination thereof. In some embodiments, the locking system 152 may include an electric locking system configured to block electrical power supplied to the actuator 112 and thereby retain a position of the actuator 112 and the VGD 110. Other embodiments of the locking system 152 may include additional or alternative components, such as a pneumatic lock, a hydraulic lock, a magnetic lock, an electromechanical lock, or any combination thereof.

It should be appreciated that embodiments in accordance with the present techniques may utilize additional and/or alternative sensors 150 configured to provide feedback to the controller 114. For example, the flow control system 94 may include sensors 150, such as position sensors, current sensors, temperature sensors, pressure sensors, flow rate sensors, contact sensors or other sensors to enable the functionality described above. In some embodiments, one or more sensors 150 may be coupled to other components of the vapor compression system 14 and/or disposed in other locations along or within refrigerant circuit 80.

As discussed above, embodiments of the present disclosure are directed to systems and methods for utilizing a variable geometry diffuser (VGD) as a flow check valve in a compressor to substantially reduce, block, or prevent undesirable refrigerant flow across the compressor and thereby mitigate spin and/or backspin of the compressor. Embodiments include an actuator configured to operate in multiple modes to actuate and move the VGD within a diffuser passage of the compressor, and the mode of operation may be based on an operational state of the compressor and/or based on a position of the VGD within the diffuser passage. The actuator may operate in a first mode when the compressor is operating in order to move the VGD within the diffuser passage and adjust a size of a flow path through the diffuser passage, such as for surge or capacity control of the compressor. The control system may operate the actuator in a second mode when the compressor is not operating in order to move the VGD within the diffuser passage and abut an opposing surface of the diffuser passage, thereby substantially completely blocking or closing the flow path through the diffuser passage. Thus, the disclosed systems and methods enable the use of the VGD to block or prevent refrigerant flow through the compressor so as to reduce spin and/or backspin of the compressor when the compressor is not operating.

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be noted that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112 (f). However, for any claims containing elements designated in any other manner, it is intended that such elements are not to be interpreted under 35 U.S.C. 112 (f).

The invention claimed is:

1. A compressor, comprising:

a diffuser passage configured to receive refrigerant flow from an impeller of the compressor, wherein the diffuser passage is at least partially defined by a compressor discharge plate of the compressor;

a variable geometry diffuser positioned within the diffuser passage and configured to adjust a dimension of a refrigerant flow path through the diffuser passage;

an actuator coupled to the variable geometry diffuser and configured to adjust a position of the variable geometry diffuser within the diffuser passage; and a controller configured to regulate operation of the actuator, wherein the controller is configured to instruct the actuator to adjust the position of the variable geometry diffuser from a first position to a second position using a first force and to adjust the position of the variable geometry diffuser from the second position to a third position using a second force less than the first force, wherein the variable geometry diffuser abuts the compressor discharge plate in the third position.

2. The compressor of claim 1, wherein the controller is configured to instruct the actuator to adjust the position of the variable geometry diffuser across a range of variable geometry diffuser positions within the diffuser passage using the first force, and the first position is within the range of variable geometry diffuser positions.

3. The compressor of claim 2, wherein the controller is configured to instruct the actuator to adjust the position of the variable geometry diffuser across the range of variable geometry diffuser positions during operation of the compressor.

4. The compressor of claim 1, wherein the controller is configured to instruct the actuator to adjust the position of the variable geometry diffuser from the second position to the third position using the second force based on a signal indicative of compressor shutdown received by the controller.

5. The compressor of claim 1, wherein the actuator comprises a sensor configured to provide feedback to the controller indicative of the variable geometry diffuser in the third position.

6. The compressor of claim 5, wherein the actuator is a motor, and the sensor is a torque sensor configured to detect a torque acting on the motor.

7. The compressor of claim 1, wherein the variable geometry diffuser is configured to completely block refrigerant flow through the compressor in the third position.

8. The compressor of claim 1, wherein the dimension of the refrigerant flow path through the diffuser passage with the variable geometry diffuser in the second position corresponds to a lower threshold dimension of the refrigerant flow path during operation of the compressor.

9. The compressor of claim 1, wherein the variable geometry diffuser is a variable geometry diffuser ring.

10. The compressor of claim 1, wherein the actuator comprises a locking system configured to maintain the variable geometry diffuser in the third position during suspended operation of the compressor.

11. A heating, ventilation, air conditioning, and refrigeration (HVAC&R) system, comprising;

a compressor configured to pressurize refrigerant within a refrigerant circuit, wherein the compressor comprises a diffuser passage configured to receive the refrigerant from an impeller of the compressor;

a variable geometry diffuser of the compressor, wherein the variable geometry diffuser is configured to be positioned within the diffuser passage and is configured to adjust a dimension of a refrigerant flow path through the diffuser passage;

an actuator configured to adjust a position of the variable geometry diffuser within the diffuser passage; and a controller configured to regulate operation of the actuator, wherein the controller is configured to reduce a first force applied by the actuator, prior to contact between the variable geometry diffuser and a compressor discharge plate, to position the variable geometry diffuser against the compressor discharge plate during stoppage of the compressor.

12. The HVAC&R system of claim 11, wherein the controller is configured to instruct the actuator to position the variable geometry diffuser against the compressor discharge plate based on an indication of compressor shutdown or compressor fault received by the controller.

13. The HVAC&R system of claim 11, wherein the controller is configured to instruct the actuator to position the variable geometry diffuser within a first range of positions within the diffuser passage during operation of the compressor and is configured to instruct the actuator to position the variable geometry diffuser within a second range of positions within the diffuser passage during stoppage of the compressor.

14. The HVAC&R system of claim 13, wherein the first range of positions and the second range of positions do not overlap with one another.

15. The HVAC&R system of claim 13, wherein the controller is configured to instruct the actuator to position the variable geometry diffuser within the first range of positions within the diffuser passage to control surge of the compressor and/or control a capacity of the compressor.

16. The HVAC&R system of claim 13, wherein the controller is configured to instruct the actuator to position the variable geometry diffuser within the first range of positions using the first force, the controller is configured to instruct the actuator to position the variable geometry diffuser within the second range of positions using a second force, and the second force is less than the first force.

17. The HVAC&R system of claim 11, comprising a first refrigerant circuit and a second refrigerant circuit, wherein the first refrigerant circuit comprises the compressor, the first refrigerant circuit and the second refrigerant circuit are each configured to exchange heat with a flow of cooling fluid, the first refrigerant circuit and the second refrigerant circuit are each configured to exchange heat with a flow of conditioning fluid, and the first refrigerant circuit and the second refrigerant circuit are arranged in a series counter-flow configuration relative to the flow of cooling fluid and the flow of conditioning fluid.

18. A heating, ventilation, air conditioning and refrigeration (HVAC&R) system controller comprising a tangible, non-transitory, computer-readable medium comprising computer-executable instructions that, when executed, are configured to cause processing circuitry to:

control an actuator to position a variable geometry diffuser in a diffuser passage of a compressor within a first range of positions during operation of the compressor;

control the actuator to position the variable geometry diffuser in the diffuser passage of the compressor within a second range of positions during stoppage of the compressor;

control the actuator to maintain a position of the variable geometry diffuser within the diffuser passage and against a compressor discharge plate of the compressor during stoppage of the compressor;

receive feedback from a sensor indicative of a torque acting on the actuator; and control the actuator to position the variable geometry diffuser against the compressor discharge plate of the compressor based on the feedback.

19. The HVAC&R system controller of claim 18, wherein the computer-executable instructions, when executed, are configured to cause the processing circuitry to:

control the actuator to apply a first force to the variable geometry diffuser to position the variable geometry diffuser in the diffuser passage of the compressor within the first range of positions; and control the actuator to apply a second force to the variable geometry diffuser to position the variable geometry diffuser in the diffuser passage of the compressor within the second range of positions, wherein the first force is greater than the second force.

20. The HVAC&R system controller of claim 18, wherein the computer-executable instructions, when executed, are configured to cause the processing circuitry to activate a locking system of the actuator to maintain the position of the variable geometry diffuser within the diffuser passage and against the compressor discharge plate of the compressor during stoppage of the compressor.

* * * * *